United States Patent [19]

Zangenberg et al.

[11] 4,275,996

[45] Jun. 30, 1981

[54] CONTROL DEVICE FOR ADJUSTABLE FLUID PUMPS OR MOTORS

[75] Inventors: Jan Zangenberg; Peter J. M. Clausen, both of Nordborg, Denmark

[73] Assignee: Danfoss A/S, Nordborg, Denmark

[21] Appl. No.: 48,243

[22] Filed: Jun. 13, 1979

[30] Foreign Application Priority Data

Jun. 13, 1978 [DE] Fed. Rep. of Germany ..... 2825827

[51] Int. Cl.[3] ..... F04B 1/06

[52] U.S. Cl. ..... 417/221

[58] Field of Search ..... 60/452; 91/506; 417/217, 218, 219, 220, 221, 222, 269

[56] References Cited

U.S. PATENT DOCUMENTS

| | | | |
|---|---|---|---|
| 3,738,779 | 6/1973 | Hein et al. | 91/506 X |
| 3,908,377 | 9/1975 | Riedhammer | 417/217 X |
| 4,028,010 | 6/1977 | Hopkins | 417/217 |

FOREIGN PATENT DOCUMENTS

| | | | |
|---|---|---|---|
| 1157080 | 11/1963 | Fed. Rep. of Germany | 417/218 |
| 1601701 | 3/1970 | Fed. Rep. of Germany | 417/217 |

*Primary Examiner*—Carlton R. Croyle
*Assistant Examiner*—Edward Look
*Attorney, Agent, or Firm*—Wayne B. Easton

[57] ABSTRACT

The invention relates to a control unit for an adjustable fluid pump or motor controlled by a servomotor. The control unit is of the type having a slide valve with a neutral blocking position with supply and exhaust positions on opposite sides of the neutral position. The neutral position provides a zero pump feed condition and the improvement resides in a construction wherein the fed amount is absolutely zero. This is accomplished with a secondary valve which has a fixed part and a moveable part which moves with the actuator. The secondary valve has fluid passages which short circuit the supply and exhaust connections of the unit over a small travel range on opposite sides of the neutral position of the actuator.

2 Claims, 4 Drawing Figures

CONTROL DEVICE FOR ADJUSTABLE FLUID PUMPS OR MOTORS

The invention relates to a control device for adjustable fluid pumps or motors, comprising a servo-piston which adjusts a servo-member of the pump, is arranged in a cylinder space and is subjected to a resetting force, and a valve which has a slide connected to an actuating element and a slide bore connected to the servo-piston and connects the pressure chamber of the servo-piston to a chamber at pump or motor pressure in its one operating position, to a chamber at discharge pressure in its other operating position and blocks in its neutral position, a central position of the slide corresponding to a position of the servo-member in which there is zero pump feed.

Numerous pumps are known in which the quantity that is fed can be changed with the air of a servo-member. These include axial and radial piston pumps with adjustable stroke, gear and vane pumps with variable compression and pumps with a variable rotary driving speed. Of particular advantage are those pumps in which the fed volume can be changed and the pumping direction even reversed by altering the eccentricity between two relatively rotating pump portions while maintaining the rotary driving speed. The servo-members for such pumps can generally be manually adjusted. It is also already known to adjust such servo-members with the aid of a servo-piston and a slave valve so that comparatively small control forces will be sufficient. In these control devices, the slide merely has a purpose in conjunction with the stated sleeve valve.

In adjustable pumps it is difficult to achieve a position in which the fed amount is absolutely zero. There is generally a small amount of feeding in the one or other direction. Intensive internal heating occurs in many adjustable pumps if the pump runs in the neutral position for a prolonged period.

The invention is based on the problem of providing a control device of the aforementioned kind with the aid of which the feed can be reduced to zero and heating of an adjustable pump can be reduced.

This problem is solved according to the invention in that the slide forms a second valve which, in the central position, interconnects the chamber at pump pressure and the chamber at discharge pressure.

In this construction, the pump pressure conduit is connected to the tank by way of the control device in a dead zone at both sides of the zero feed position. Any liquid that might be fed by the pump is immediately diverted into the tank without any substantial build-up in pressure. The power loss of the pump is correspondingly low. Heating is also at a minimum. On the contrary, a small throughput is even desired because it cools the pump. All this requires no marked additional expense because the slide takes on the function of the second valve.

Further, the slide may be movable out of the central position against the force of a first resetting spring in the one direction and against the force of a second resetting spring in the other direction, each spring being prestressed. In the absence of an external control force, the slide therefore immediately returns to its central position so that the pump will no longer feed and will therefore always operate at a low loss if there is no corresponding control command.

In a preferred embodiment, it is ensured that the slide sealingly passes through a bore between the chamber at pump pressure and the chamber at discharge pressure and has an axial passage at the periphery that is longer than the bore. The second valve function therefore only requires a very slight modification of the control device.

In particular, the bore can be formed in a sleeve which is arranged with radial play and has its end face sealingly pressed by a resetting spring and the differential pressure applied thereto against a dividing wall between the two chambers. In this way one can prevent jamming of the slide that might arise if for reasons of production it is not possible accurately to align the slide bore and the bore in the second valve. An accurately defined central position is achieved by an inner collar fixed with respect to the housing, an outer collar on the slide fitting through the circular section of the inner collar, and two annular discs at both sides of the collars that serve as supports for the resetting springs and cover both collars.

If the outer collar is provided on an axially screw-connectible housing portion, one can thereby change the central position and accurately adapt it to the zero feed position of the pump.

In a very simple construction, the collars are formed by circlips sprung into a groove fixed with respect to the housing and a groove on the slide.

Preferred examples of the invention will now be described in more detail with reference to the drawing, wherein.

Figure 1:
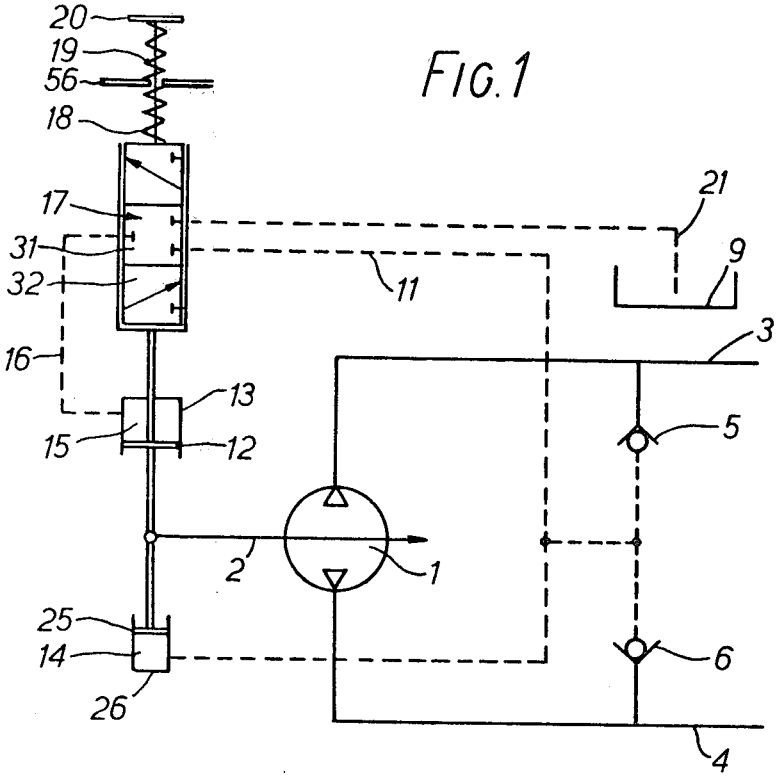
FIG. 1 is a diagrammatic circuit diagram for an adjustable pump with control device.

An adjustable pump 1, e.g. a radial piston pump according to DE-AS No. 18 12 635, comprises a servo-member 2 with the aid of which the eccentricity between a rotating pump portion, e.g. a radial piston carrier, and a fixed pump portion, e.g. a piston track, can be so adjusted that the delivered quantity can be varied and even the direction reversed. Both pump connections 3 and 4, which may be connected in conventional manner to a load and a tank, communicate by way of a respective check valve 5, 6 with a control conduit 11 which is always at pump pressure.

The servo-member 2 is connected to a servo-piston 12 which is arranged in a cylinder 13 and to a small auxiliary piston 25 which is accommodated in a cylinder 26. A resetting pressure chamber 14 in this cylinder is always connected to the control conduit 11. On the other hand, the actual working chamber 15 communicates by way of a conduit 16 with a valve 17 of which the sleeve 32 is mechanically coupled to the servo-piston 12 and the slide or valve member 31 is subjected to two resetting springs 18 and 19 and can be adjusted with the aid of an actuating element 20. In the illustrated rest position, the conduit 16 and thus the working chamber 15 are blocked. The position of the servo-element 2 is thus fixed. In the one operating position, the working chamber 15 is connected to the pump pressure conduit 11 and in the other operating position to a discharge conduit 21. In this way the servo-member 2 can be adjusted in the one or other direction.

Figure 2:
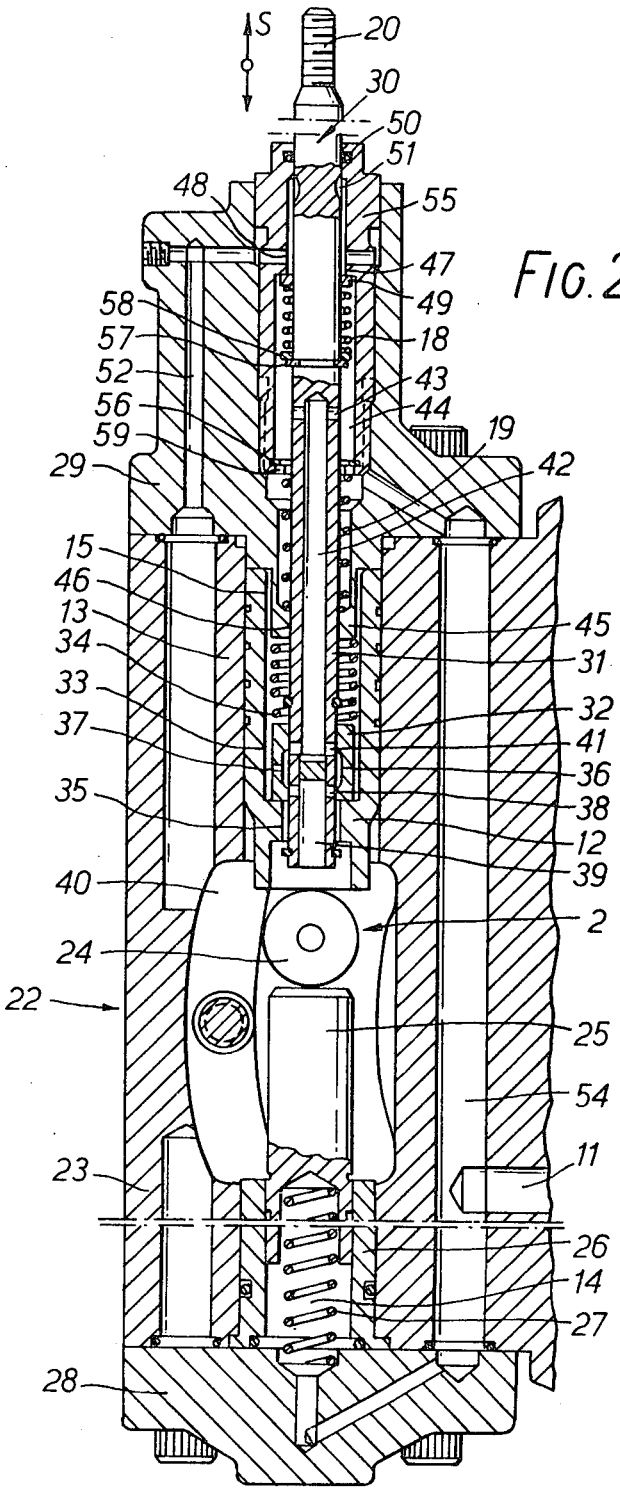
FIG. 2 is a longitudinal section through a control device according to the invention.

FIG. 2 shows the construction of a control device 22 in detail. In a housing 23, a pin 24 connected to the servo-member 2 is disposed between the actual servo-piston 12 and the auxiliary piston 25. The latter is subjected to a spring 27. The housing 23 also comprises the cylinder 13. It is closed at the bottom by a cover 28 and at the top by a cover 29.

A slide 30 is formed at the outer end as an astuating element 20 and at the opposite end as a valve member 31 of which the slide bore is provided in a sleeve 32. The sleeve is arranged with radial play in a bore 33 of the servo-piston 12 that is part of the working chamber 15 and its lower end face is sealingly pressed against a dividing wall 35 by a spring 34 and by the differential pressure acting on it. In the sleeve 32 there is an annular groove 36 which on the one hand communicates with the pressure chamber 15 by way of a throttle bore 37 and on the other hand, upon relative displacement between the sleeve 32 and the valve member 31, is connected to a chamber 40 at discharge pressure by way of transverse bores 38 and an axial passage 39, or to a chamber 44 at pump pressure by way of transverse bores 41, an axial passage 42 and further transverse bores 43.

The chamber 44 is separated from the pressure chamber 15 by a dividing wall 45 which has a bore 46 sealingly abutting the periphery of the slide 30. A third dividing wall 47 separates the chamber 44 from a second chamber 48 at discharge pressure. Here, again, there is a sleeve 49 which sealingly surrounds the slide 30 but is arranged radially with play. This sleeve 49 has its end face sealingly pressed against the dividing wall 47 by the resetting spring 18 and the differential pressure applied thereto. At the other end, the chamber 48 is sealed by an O-ring seal 50. Axial passages 51 are provided in the slide 30; they are longer than the sleeve 49 is high so that in the central position (not shown) of the slide 30 a short-circuit occurs between the chambers 44 and 48 by way of these axial passages 51.

The chamber 48 is connected by way of housing passages 52 to the chamber 40 and the latter is connected to the tank conduit 21. The chamber 44 and the chamber 14 are likewise connected to the pump pressure conduit 11 by way of housing passages 54.

An axially screw-connectible housing portion 55 is inserted in the cover 29. In an annular groove, it carries an inner collar 56 in the form of a circlip. In an annular groove, the slide carries an outer collar 57 in the form of a circlip of which the external diameter is smaller than the internal diameter of the collar 56. Both resetting springs 18 and 19 are associated with an annular disc 58 and 59 which tend to cover both collars 56 and 57. In the rest position, the collar 57 is therefore pressed into the plane of the collar 56 by the two springs. In this way the central position is decided. By turning the housing portion 55, this central position can be accurately adapted to the zero feed position of the pump.

Figure 3:
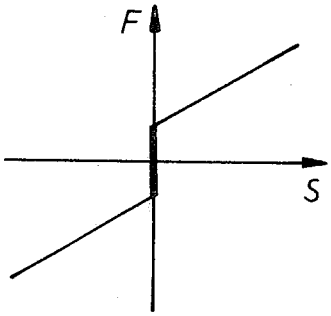
FIG. 3 is a diagram of the resetting spring forces against the displacement of the slide unit.

FIG. 3 shows that one of the two resetting springs 18 and 19 is associated with each direction of movement and that these springs are prestressed in the central position (S=0) so that this central position is obtained with a certain amount of force when no external control forces are provided.

Figure 4:
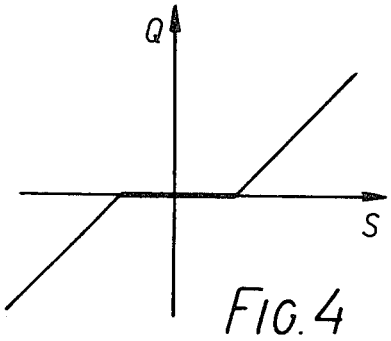
FIG. 4 is a diagram of the feed against the displacement of the slide unit.

FIG. 4 shows that the quantity q fed by the pump has a dead zone in the region of the central position. This arises out of the short circuit between the pump pressure side and the tank by reason of the axial passages 51. In the region of this dead zone, the liquid is circulated externally of the pump so that continual cooling takes place and the pump does not become too hot as a result of internal circulation.

What is claimed is:

1. A control unit for an adjustable fluid pump or motor controlled by a servomember, comprising, a housing having fluid pressure supply and exhaust connections, slide valve means having a neutral blocking position with supply and exhaust positions on opposite sides thereof respectively connectable to said supply and exhaust connections, actuator means for said slide valve means having a neutral position servopiston means including an expansible chamber selectively connectable by said actuator means and said slide valve means to said supply and exhaust connections to operate said servopiston, resetting means for biasing said servopiston in a resetting direction, second valve means connected to said actuator means to provide fluid communication between said supply and exhaust connections when said actuator means is in its neutral position, said second valve means including a sleeve member in surrounding relation thereto and having a fixed position relative to said housing, said actuator means having a slide member portion sealingly cooperable with said sleeve member and having axially extending recess fluid passage means of greater axial length than said sleeve member and extending on opposite sides thereof when said actuator means is in its neutral position.

2. A control unit according to claim 1 wherein said housing includes exhaust and pressure chambers surrounding said actuator means and a dividing wall for said chambers, said sleeve member being in said pressure chamber, and spring means and a differential pressure effect biasing said sleeve member into constant sealing engagement with said dividing wall.

* * * * *